US007428189B2

(12) United States Patent
Hubicki

(10) Patent No.: US 7,428,189 B2
(45) Date of Patent: Sep. 23, 2008

(54) ELECTRONIC ASSISTANT AND METHOD

(76) Inventor: Joseph Thomas Hubicki, 7816 Winston Rd., Philadelphia, PA (US) 19118

( * ) Notice: Subject to any disclaimer, the term of this patent is extended or adjusted under 35 U.S.C. 154(b) by 0 days.

(21) Appl. No.: 11/901,095

(22) Filed: Sep. 14, 2007

(65) Prior Publication Data

US 2008/0074951 A1 Mar. 27, 2008

Related U.S. Application Data

(60) Provisional application No. 60/845,873, filed on Sep. 21, 2006.

(51) Int. Cl.
*G04B 47/00* (2006.01)
*G04C 21/14* (2006.01)

(52) U.S. Cl. ..... 368/10; 368/63

(58) Field of Classification Search ..... 368/10, 368/63; 200/11 R; 341/35
See application file for complete search history.

(56) References Cited

U.S. PATENT DOCUMENTS

| | | | | |
|---|---|---|---|---|
| 4,027,128 | A * | 5/1977 | Walker | 200/507 |
| 6,990,047 | B1 * | 1/2006 | Barbagiovanni et al. | 368/10 |
| 2005/0058026 | A1 * | 3/2005 | Hocherman | 368/73 |
| 2005/0190655 | A1 * | 9/2005 | Blumberg | 368/73 |

* cited by examiner

*Primary Examiner*—Vit W. Miska
*Assistant Examiner*—Sean Kayes
(74) *Attorney, Agent, or Firm*—Howson & Howson LLP

(57) ABSTRACT

An electronic assistant issues audible, spoken, digitally recorded, medication reminders at programmed times, entered using a microphone and a recessed rotary switch that requires a tool for access. The device repeats medication reminders, and, if the reminders are not acknowledged within a predetermined time, it generates an audible alarm as well as an electronic signal that summons help and includes GPS-derived location information. A spoken medical history can be recorded digitally in the same device for playback by emergency personnel.

17 Claims, 5 Drawing Sheets

ELECTRONIC ASSISTANT AND METHOD

CROSS-REFERENCE TO RELATED APPLICATION

This application claims priority from provisional patent application Ser. No. 60/845,873, filed Sep. 21, 2006. The disclosure of the provisional application is incorporated by reference.

FIELD OF THE INVENTION

This invention relates to a hand-held device for automatically issuing audible spoken reminders for use by individuals with impaired memory, or other conditions such that they require reminders such as instructions to take medication at prescribed times. The invention also relates to a hand-held reminder device that incorporates other optional features, such as an audibly recorded medical history, and an automated alarm for summoning help when the individual has become incapacitated. The invention is usable by individuals with Alzheimer's disease, AIDS, diabetes, autism, cancer, and a variety of other conditions, and also by patients recovering from cataract surgery, and elderly individuals who have no specific illness but who spend time alone and need assistance from time to time.

BACKGROUND OF THE INVENTION

Many people are required to take several different medications, which must be taken at prescribed times. Keeping track of multiple medications, and remembering whether or not those medications have been taken, is a challenging task even for people with strong memories. For people who have poor memories, it nearly impossible to maintain a medication regimen accurately without assistance. Oncology patients, in particular, are often required to take a series of different medications, in different quantities, at different times. Thus, an oncology patient, even one with an excellent memory, good cognitive skills, and a high degree of alertness, can depart inadvertently from a prescribed regimen. Medical non-compliance, that is, failure to take a proper dose of medication at the prescribed time and in the prescribed amount, is a serious problem.

A calendar pill box is commonly used to assist an individual in remembering to take medications on a daily basis. Such a box typically has a separate, labeled, compartment for each day of the week. The user can readily determine whether or not the prescribed daily medication was taken by observing whether or not the compartment corresponding to the current day is empty. A problem with a conventional daily calendar pill box is that it does not help a person who needs to take medications multiple times in a single day. A more elaborate pill box, having multiple compartments for each day, is possible. However, it is more complicated, and more difficult to use. Furthermore, in general a calendar pill box is bulky and difficult for a person to carry when traveling.

Another solution to the problem of assisting an individual to remember prescribed times for taking medication is to provide an electronic reminder. For example, a microprocessor can be programmed to issue reminders using existing telecommunications equipment such as telephones, pagers, and the like. Such systems are exemplified by U.S. Pat. No. 5,657,236 to Conkright, entitled "Medication Dispensing and Timing System Utilizing Patient Communicator with Internal Clock." A problem with such systems is that they are typically expensive and difficult to program. In addition, electronic devices, such as personal digital assistants (PDAs), and even certain cellular telephones, incorporate calendar and alarm features and can be programmed to generate alarms at different times to inform a person of an appointment, meeting, or other event. Such devices can be programmed to issue reminders that a person should take certain medications. PDAs, such as the PDA described in U.S. Pat. No. 4,302,752 to Weitzler, entitled "Electronic Reminder," have even been specifically designed to track medication times.

A problem associated with programmable PDAs is that they are often not user friendly to the elderly. For example, it is typically quite difficult to set multiple alarms. PDAs also usually have small displays, and either small keypad buttons or on-screen buttons that require a stylus. Often the display cannot be easily seen by the elderly, and an elderly individual often cannot easily utilize a small keypads or an on-screen keypad. Furthermore, PDAs are relatively complex devices that require skill to program and operate. An elderly person, and especially a person with a failing memory, usually lacks the ability to remember how to program and operate a traditional PDA.

In addition to keeping track of medications, a person with a condition such as cancer, diabetes, autism, Alzheimer's disease, or AIDS, will typically have other health issues. Many patients are treated by different doctors for different problems. For example, an individual might regularly see both a general practitioner and a cardiologist. Each of these physicians may prescribe medications. It is important for each of them to know what medications are being prescribed by the other. Oncology patients, for example, may take as many as sixteen or more doses of medications on a given day. Some elderly patients may have similar medication requirements. In such cases, it is exceedingly difficult for a patient to convey to a physician essential information concerning his or her treatment by another physician. In an emergency, it is also often difficult for an emergency medical technician, or an attending emergency room physician or nurse to obtain essential information concerning a patient's medical history.

In severe cases of memory loss or reasoning skills, such as often occur with Alzheimer's disease and with dementia due to other causes, a person often cannot remember any useful information. However, such individuals may be otherwise physically fit, and may wander out of a house and become lost. Identification bracelets offer only a partial solution to this problem. If the individual becomes injured, an emergency medical technician, emergency room physician, or other healthcare professional, has no easy way to evaluate the individual's medical history, and no easy way to determine what medications are being taken by the patient. Although implantable electronic devices for recording identification information and medical history are available, they are not practical for all individuals.

Another problem encountered from time to time, especially by elderly individuals living alone, is that they become injured in a fall, or otherwise become incapacitated and unable to summon help. One proposed solution is to have the individual carry an electronic device that can be activated by pushing a button to send out a radio signal to a central monitoring station, either directly or by way of a telephone dialing device. Often, however, the individual will have forgotten to carry the device, or will be unable to use it. When this occurs, the individual may be stranded for a long period of time, sometimes with serious or disastrous consequences.

A need therefore exists for a simple, reliable, and easily programmed electronic assistant that can be used by an elderly individual as well as by an individual with a condition such as AIDS, cancer, diabetes, Alzheimer's disease, or autism, to ensure that required medications are taken at the proper times, to ensure that the patient's medical history can be accurately and rapidly determined, to ensure that information is accurately shared by multiple physicians treating the same patient, to enable an ambulatory patient to be found if he or she becomes lost, and to summon help automatically when needed in the case where the patient is unable to summon help voluntarily. Embodiments of this invention address one or more of these needs.

SUMMARY OF THE INVENTION

The invention is a device and method for assisting a person with medical non compliance, medical history tracking, and wandering issues. The device according to the invention is a hand-held electronic unit that includes a loudspeaker, random access memory, a microprocessor, a clock, and a programming switch that can be operated easily by a caregiver using a proper tool, but that cannot be easily operated without the use of the tool. In the programming process, the switch can be used to set the clock, to select times at which spoken reminder messages are to be reproduced, to permit entry of the spoken messages by the caregiver, and to permit entry of a spoken medical history by one or more physicians. At each programmed time, referred to as an "event time," the spoken message corresponding to the event time is retrieved from the memory and reproduced through the loudspeaker. The message is repeated up to a predetermined number of times until the patient operates a button to indicate the message has been heard, and that the patient will comply.

In addition to its function as an event reminder, the device can also store identification information concerning the patient, and pertinent information concerning the patient's medical history. When properly prompted, the device can audibly reproduce the identification information and medical history information for use by a healthcare provider or other caregiver.

The device also has the capability of issuing an alarm when the patient has not interacted with the device. If, at any given event time, the number of repetitions of the corresponding audible reminder message exceeds the above mentioned predetermined number (or, optionally, another, lower, predetermined number) without having been acknowledged by the patient's pressing a button, the device issues a loud audible alarm through its loudspeaker in order to summon assistance. In addition, the device can automatically issue a signal to an automatic telephone dialer to summon help from a caregiver or a central monitoring station. Optionally, the device can include a global positioning system (GPS) receiver, and automatically transmit a radio signal that summons help and includes the coordinates of the patient's location.

More particularly, the electronic assistant according to the invention comprises a memory for recording voice messages, a clock, a loudspeaker connected to the memory for audibly reproducing the recorded voice messages, and a programmable control responsive to the clock, and connected to the memory, for causing recorded voice messages to be reproduced at predetermined times through the loudspeaker. A manually operable clear switch is connected to the programmable control and the programmable control causes the reproduction of each recorded message to be repeated at least a predetermined plural number of times unless the clear switch is operated.

A preferred embodiment includes an alarm generator, and the programmable control causes the reproduction of each recorded message to be repeated a predetermined plural number of times, and causes an audible alarm to be produced by the alarm generator if the clear switch is not operated within a predetermined interval beginning at the time the playing of a recorded message begins. This predetermined interval may correspond to the timer required for the predetermined number of repetitions of the recorded message.

In accordance with one aspect of the invention, the programmable control comprises a multi-position switch having a mechanically movable switch-operating element, located in a recess in a case containing the components of the device, at a position such that it is inaccessible by an individual's finger, and operable only by insertion of a tool, such as a screwdriver, into the recess.

The electronic assistant preferably includes a microphone, and the programmable control comprises a multi-position switch. Each one of a plurality of positions of the switch is associated with a different time of day, and the switch is connected to the microprocessor and operable to enable an individual to select a particular time of day for reproduction of a voice message, and to enter said voice message into the memory by speaking into the microphone so that the entered voice message is associated with the particular selected time of day and reproduced through the loudspeaker at that particular selected time of day.

The multi-position switch also preferably includes a position in which it allows an additional voice message, such as a spoken medical history, to be recorded in the memory, and including a second manually operable switch connected to the microprocessor for causing the additional voice message to be reproduced whenever the second manually operable switch is operated.

In accordance with another aspect of the invention, the electronic assistant preferably comprises a memory for storing audio messages, programmable means for reproducing audible, stored, reminder messages from the memory at preprogrammed times, means for entering an acknowledgment of a reminder message, and means for generating an alarm when a reminder message is not acknowledged within a predetermined interval of time. The electronic assistant also preferably includes manually operable means for causing a stored message other than said audible reminder messages to be reproduced audibly from the memory.

Another aspect of the invention resides in a method of assisting an individual. The method comprises the steps of: providing a portable, handheld, electronic device containing a clock, a loudspeaker, a microprocessor, and a memory; programming event times into said electronic device; recording audio messages into the memory that correspond to said event times, and retrieving an audio message from the memory that corresponds to an event time and reproducing the message audibly through the loudspeaker when the event time occurs.

The method can include the step of recording the individual's medical history into said memory as an audio message and the step of retrieving the individual's medical history by reproducing the medical history audibly through said loudspeaker.

Preferably, the reproduction of the retrieved message is repeated and the repetition of the message is discontinued by manual operation of a clear switch on the portable, handheld, electronic device. The microprocessor can cause an alarm to be generated if the user has not interfaced with the device for a predetermined interval of time. For example, the alarm can be generated if the clear switch is not operated within a predetermined time following the beginning of reproduction of a retrieved message. The alarm can be an audible alarm, a radio signal or both. The method can include the step of determining the location of the device by means of a global positioning system receiver in the device. The alarm can then be in the form of a radio signal that includes information concerning the location of the device, derived from the global positioning system receiver.

Event times are programmed into the electronic device by operation of a switch operating element of a rotary switch, the switch operating element being inaccessible by the user's finger but accessible by manually operable tool.

DETAILED DESCRIPTION OF THE PREFERRED EMBODIMENT

Figure 1:
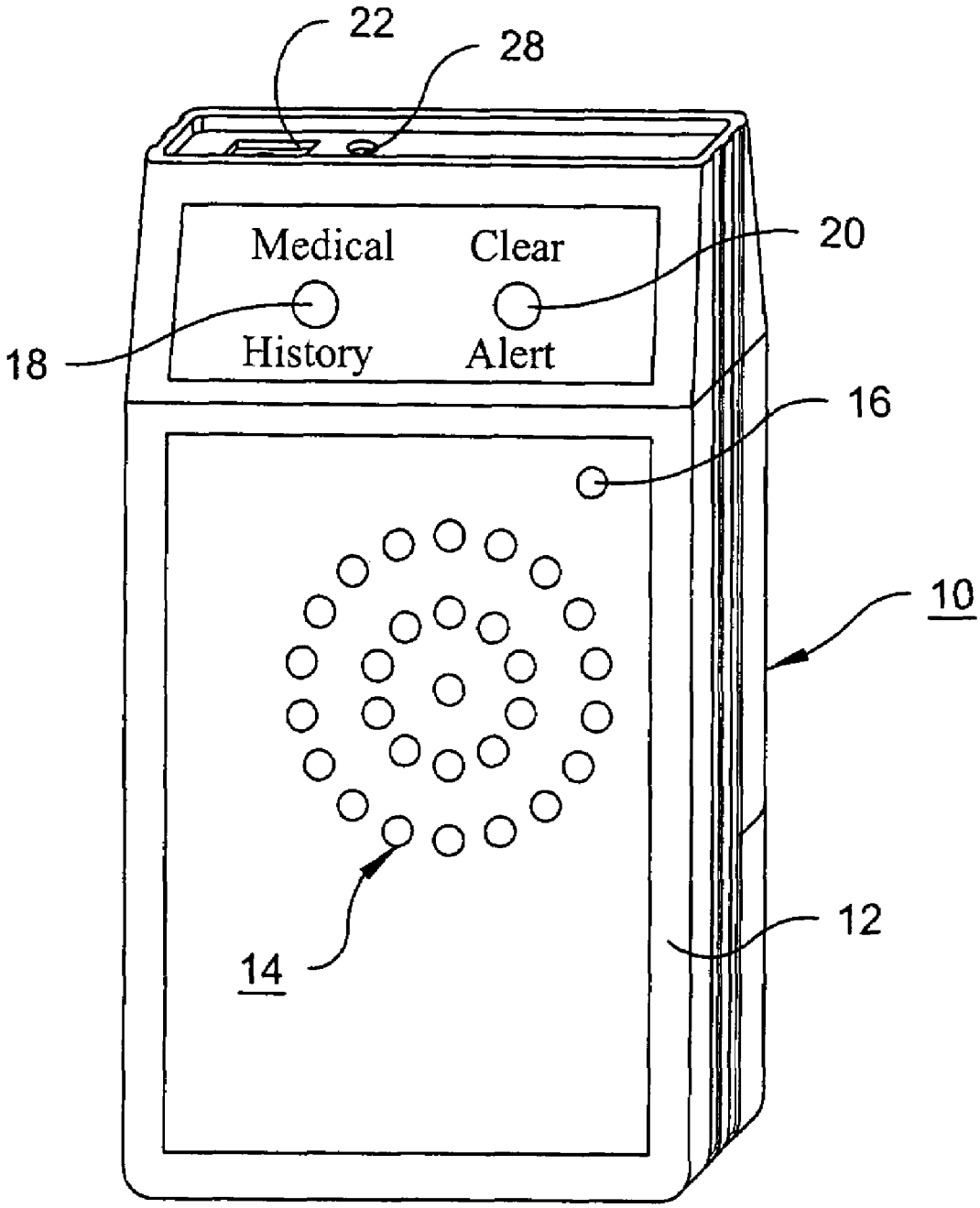
FIG. 1 is a perspective view of the exterior of an electronic assistant in accordance with the invention.

The invention is especially useful for storing and audibly reproducing an individual's medical information; for generating timely audible reminders of an individual's medication schedule; and for generating an alarm if the individual becomes incapacitated.

Referring to FIGS. 1 -5, the device according to the invention is a hand-held unit 10 comprising a case 12 of a size such that it can be readily held in a user's hand and stored in a user's pocket. The device includes loudspeaker 14 and a microphone 16. A manually operable "medical history" button 18 is provided on the case 12, and a second button 20 is also provided on the case. Button 20 has two modes of operation, one in which it serves as a "clear" button, and another in which it serves as an "alert" button. In its "clear" mode, button 20 is used to enter an acknowledgment of an audible reminder message reproduced by loudspeaker 14, thereby preventing the message from being repeated. In its "alert" mode, button 20 allows the user to generate an alarm voluntarily.

Figure 3:
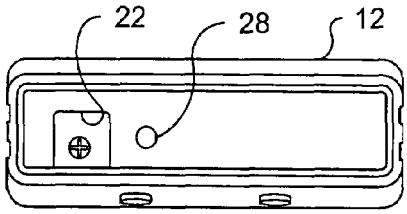
FIG. 3 is a top plan view thereof.
Figure 5:
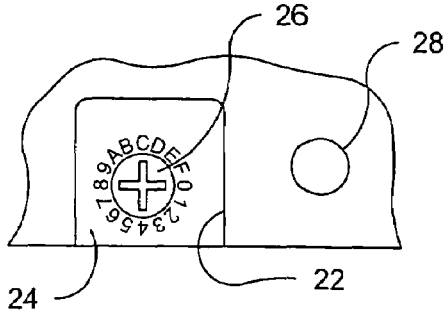
FIG. 5 is an enlarged view of a portion of the top of the electronic assistant, showing details of the rotary switch.
Figure 2:
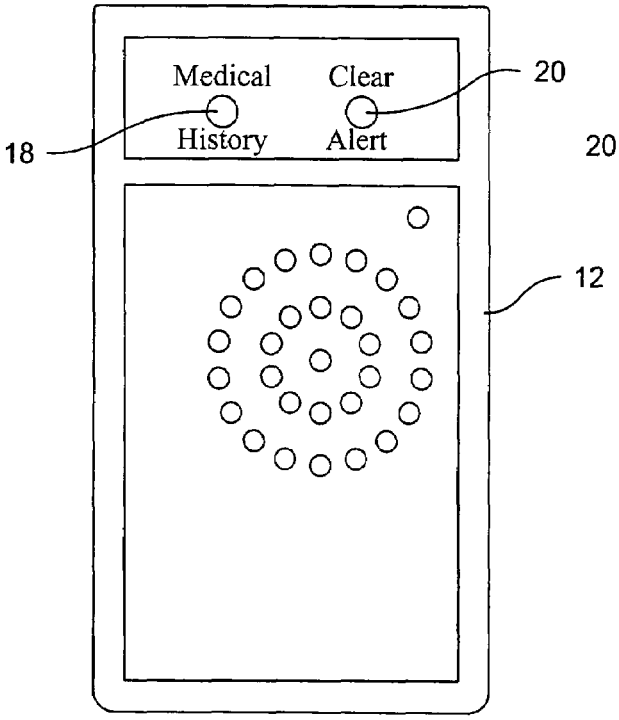
FIG. 2 is a front elevational view thereof.
Figure 4:
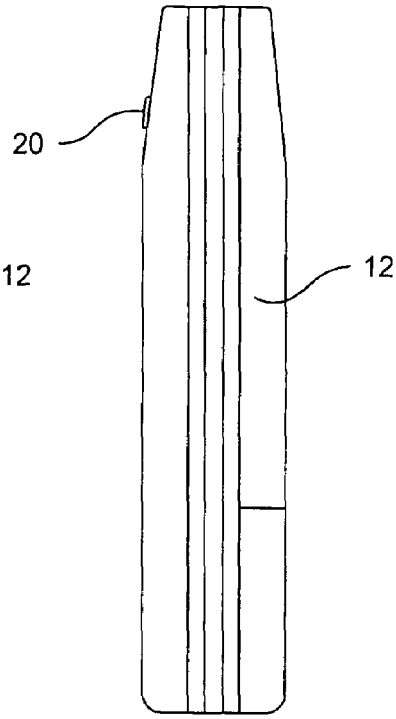
FIG. 4 is a right side elevational view thereof.

As shown in FIGS. 1, 3 and 5, the case is provided at one of its ends with an opening 22, in which a sixteen-position rotary switch 24 is located. The switch has a rotatable operating element 26, slotted to receive the tip of a Phillips screwdriver. The switch has visible position markings, and is recessed in the opening 22. The opening 22 should be of a size such that a screwdriver or other suitable tool is needed to rotate element 26 and an adult cannot use a finger to operate element 26. The rotary switch is thus made tamper-resistant.

A light-emitting diode (LED) 28 is provided adjacent the switch to indicate the time of day by flashing a number of times corresponding to the hour. The device is preferably programmable to operate over an eleven hour interval, e.g. from 8:00 AM to 7:00 PM so that there is no ambiguity concerning the meaning of the number of times the LED flashes. However, in an alternative mode, the LED can be made to flash in the twenty-four hour military time system. Another purpose of the LED is to provide visual confirmation of audio programming.

The case 12 includes a battery compartment having a removable cover 28 for battery replacement. The batteries can be either rechargeable batteries or batteries designed to be disposed of when exhausted.

Figure 6:
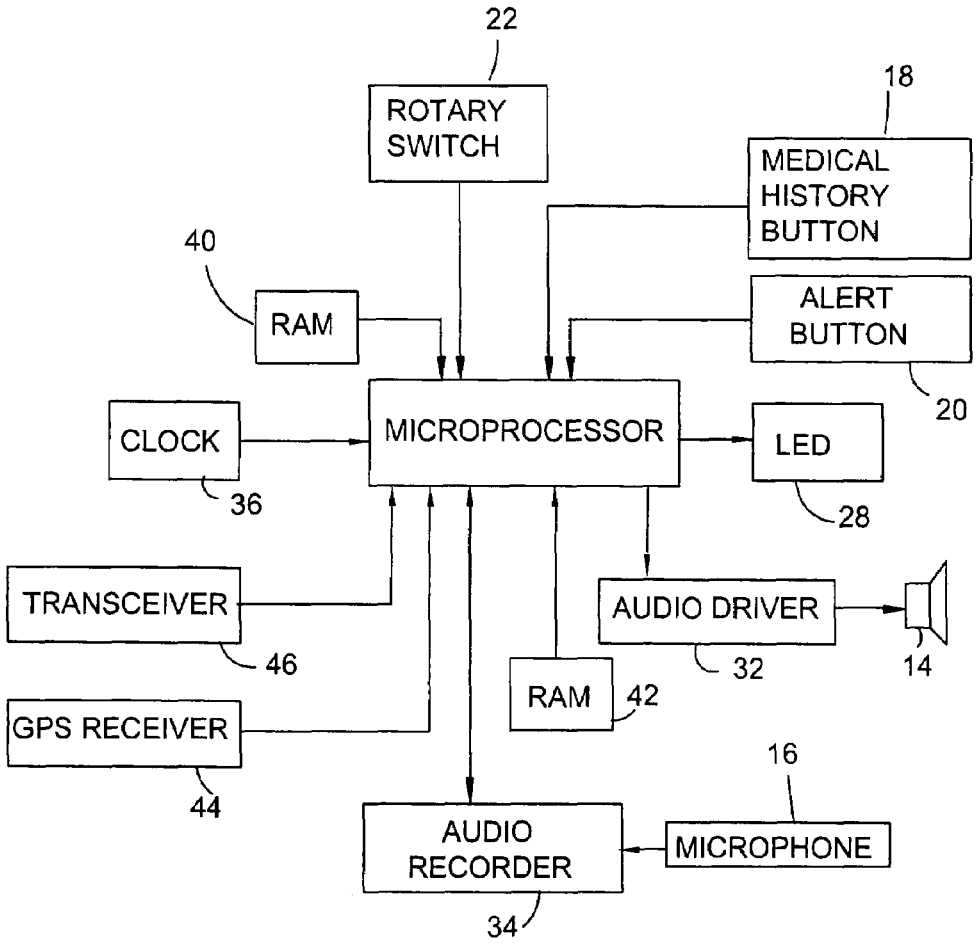
FIG. 6 is a block diagram showing the principal components of the electronic assistant.

As shown in FIG. 6, the components in the case 12 include the loudspeaker 14, the medical history button 18, the alert/clear button 20 and the rotary switch 22. The buttons 18 and 20, and the rotary switch 22 are connected to a microprocessor 30 through conventional interfaces (not shown). The loudspeaker 14 is driven by an audio driver 32 controlled by the microprocessor, and the microphone is connected to an audio recorder 34, which is preferably a digital memory, controlled by microprocessor 30. The microprocessor can be hard programmed or may run programming software. A clock 36 generates a clock signal to operate the microprocessor. This clock signal also enables the microprocessor to keep track of time so that it can generate reminders at programmed times, typically on the hour. The microprocessor preferably has the ability to track both the time and the date.

Random access memory (RAM) units 40 and 42 are also connected to the microprocessor 30 in order to store programming for the microprocessor, to store the times at which reminder messages are to be reproduced, and to store other data, such as GPS information. At least one of the random access memories, together with the microprocessor, serve as a control for causing recorded voice messages to be reproduced at predetermined times through the loudspeaker The operation of the apparatus of FIG. 6 is illustrated in the flow diagrams of FIGS. 7 and 8.

Figure 7:
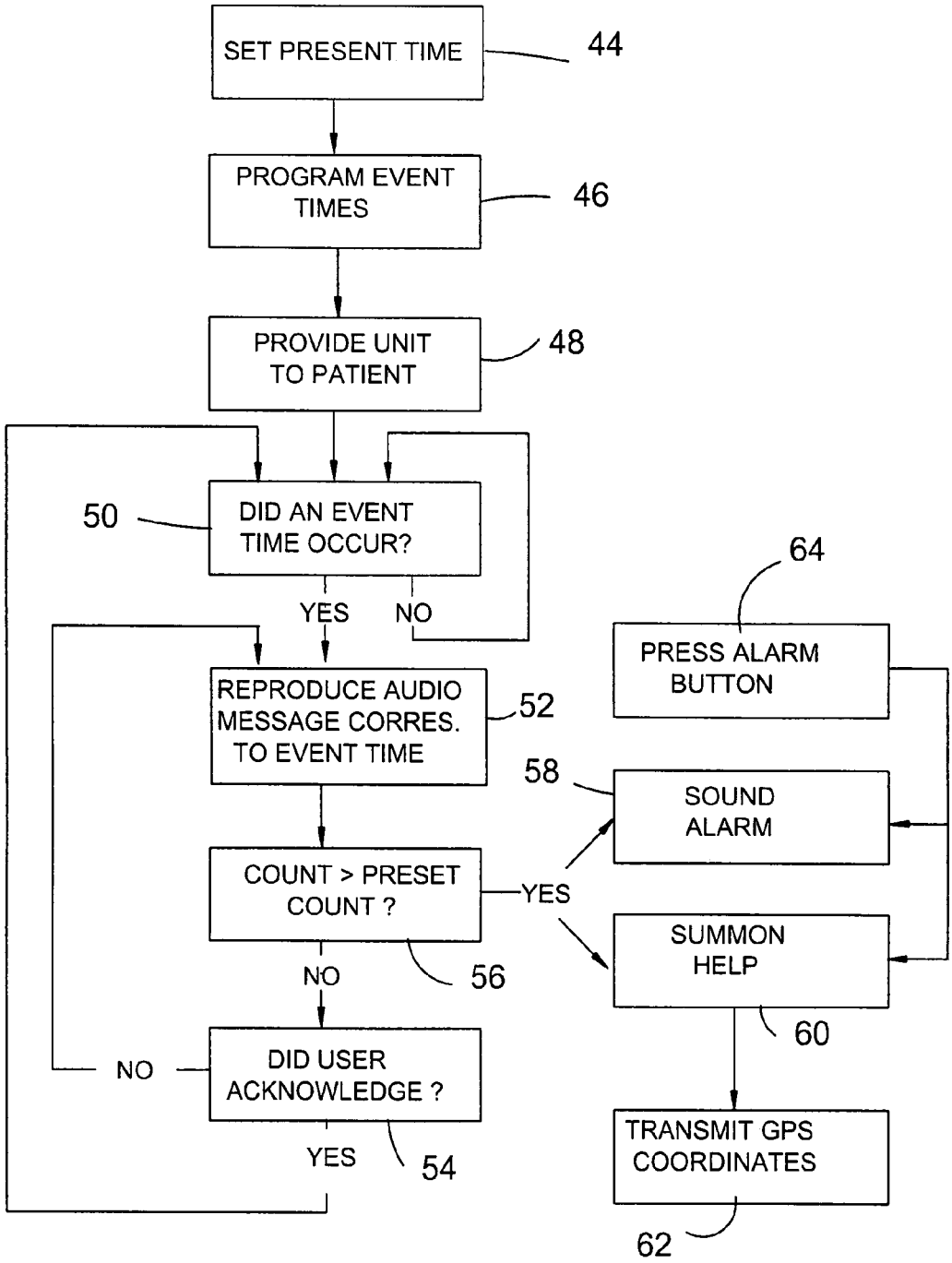
FIG. 7 is a flow diagram illustrating the programming steps and operation of the device in issuing medication reminders and alarms.

As shown in FIG. 7, a physician or caregiver initially sets the current time of day in step 44 by rotating the rotary switch to a predetermined position, e.g. position "1". When the rotary switch is in this position, the medical history button is set to a time setting mode, and the time can be set by depressing the "medical history" button 18 an appropriate number of times. Preferably, the time is set on the hour, in which case it is unnecessary to enter minutes. After each depression of the button, LED 28 flashes a number of times corresponding to the currently set hour. In a more elaborate alternative embodiment, minutes can be entered by depressing the clear/alert button, the time can be displayed using one or more additional LEDs, an LCD or numerical LED display, or by playing the time audibly using a digital voice synthesizer.

The individual programming the device can then proceed to step 46, in which he or she enters spoken voice messages and associates each of them with a particular time of day. For example, the programmer can select position "2" on the rotary switch, using a Phillips screwdriver. This switch position can correspond to 8:00 AM. While holding the "medical history" button 18 (which will now be in a "reminder entry" mode) enter a spoken message such as "Good morning. It's 8:00 AM, and time to take your heart medicine-the pink tablet in your pill box." If the next medication is due at noon, the programmer rotates the rotary switch to position 6, and enters another message, e.g., "It's noon. Time to take your blood pressure medicine—the yellow pill on the second shelf of the medicine cabinet." Information concerning allergies, medication dosages and frequency, and other pertinent information can be included in the recorded medical history. It is also possible for the patient to record a spoken living will in the same way in which the medical history is recorded. When programming is completed, the rotary switch is rotated to position "0", and the unit is given to the patient in step 48.

From that time, the device will issue audible reminders automatically, and without user intervention, at the programmed times daily until it is reprogrammed. As shown in FIG. 7, the device will proceed to step 50, in which it waits for an programmed event time to occur. If an event time occurs, e.g., if the time is 8:00 AM, the heart medicine reminder will be reproduced audibly in step 52. The patient will normally acknowledge the reminder promptly, in step 54, by pressing the "clear" button 20, in which case, the device will return to step 50. If the reminder is not acknowledged in step 54, the device will revert to step 52 and repeat the reminder. A preset count, e.g. 20 or 30 repetitions (preferably a permanent present count), is established in one of the memories. The repetitions are counted in a counting step 56 and compared with the preset count. If the preset count is exceeded, the device proceeds from step 56 to an alarm stage, in which it causes the loudspeaker to sound an alarm (step 58) and simultaneously issues a signal summoning help in step 60. In some embodiments of the device, help can be summoned by having the device automatically operate a telephone dialer through a short range radio link, e.g., a 900 MHz or 5.8 GHz portable telephone link. In other embodiments, the device can transmit an alarm through a longer range radio link, or a cellular telephone network, to a monitoring station. The alarm transmitted to the monitoring station can include, in step 62, position data derived from the GPS receiver in the device, thereby immediately notifying the monitoring station of the location of the patient, even if the patient is away from home. The GPS information can also be used to locate the device itself if it is lost.

As shown in FIG. 7, the patient can voluntarily press the alarm button in step 64. This which will cause the audible alarm to be activated in step 58, and summon help in step 60.

The audio recorder 34 (FIG. 3) also records medical history information, which can be reproduced by emergency personnel and others when needed without the need for auxiliary equipment.

Figure 8:
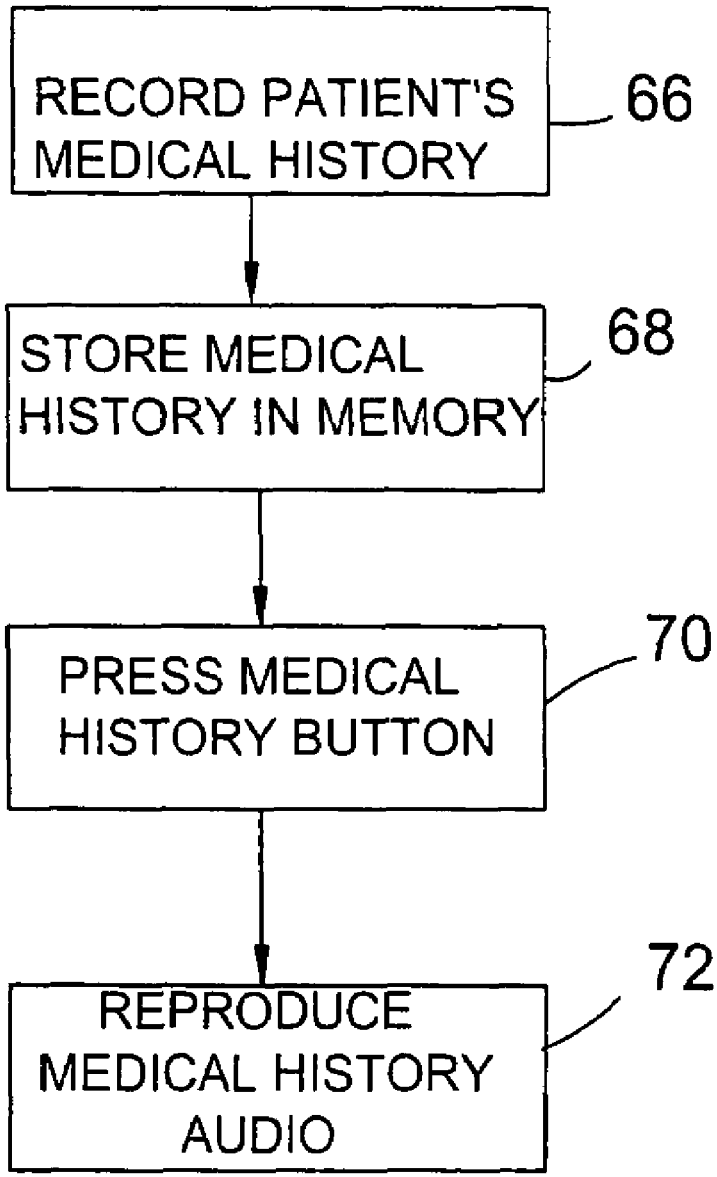
FIG. 8 is a flow diagram illustrating the manner in which the electronic assistant is used to store and reproduce medical information.

As shown in FIG. 8, in step 66 a physician or other individual can record all or a portion of a patient's medical history by rotating the rotary switch 22 to a suitable predetermined position such as position "F", and speaking into the microphone 16 while holding the medical history button 18 in depressed condition. The information will be recorded in the audio recorder 34 (FIG. 6) and remain stored therein in step 68 when the rotary switch is rotated away from position F. Normally the switch will be returned to position "0", its normal position. When the switch is in its normal position, the medical history button 18 can be depressed to retrieve the patient's medical history, which will be reproduced audibly through the loudspeaker. To retrieve a medical history, the "medical history" button is depressed in step 70 to reproduce an audio version of the patients medical history. Therefore, the patient's medical history can be reviewed quickly in the case of an emergency.

The microprocessor can be programmed to begin playing the already recorded medical history automatically when the rotary switch is rotated to position "F", and to begin recording only when the "medical history" button 18 is depressed. When the device is programmed in this manner, two or more individuals can enter medical history information sequentially, and the entire medical history can be reproduced audibly by depressing the "medical history" button when the rotary switch is in the "0" position.

As will be apparent from the above description, the electronic assistant according to the invention has a number of advantages, especially in that it is simple and easy to use, and in that it incorporates a combination of features especially useful to an individual such as an elderly person or an individual whose memory is impaired. Any caregiver, even one lacking training, can program the electronic unit in a short time, using a simple screwdriver as a tool for access to the programming switch. The issuance of spoken reminders, the storage of a spoken medical history, and the automatic alarm and help-summoning features address some of the most important issues faced by elderly and memory-impaired individuals. The device's capability of issuing easily programmed spoken reminders also makes it especially useful to oncology patients, AIDS patients, and others for whom complex medication regimens have been prescribed.

Various modifications can be made to the device and method described. For example, the electronic assistant can be used to issue reminders relating to subjects other than, or in addition to, the user's medication schedule. For example, the user can be reminded from time to time to make sure that his or her stove has been turned off. Similarly, a diabetic patient can be reminded to conduct a blood sugar test.

Although a rotary switch is preferred because of its simplicity and because it lends itself readily to tamper-resistance, other forms of switches, such as miniaturized banks of toggle switches provided in dual in-line packages (DIP switches) can be used.

A USB port or other connection means can be provided on the electronic unit to enable the unit to be attached to a computer for the purpose of programming or downloading data. With this option, the device can be programmed either through the programming switch 22 and the microphone, through a remote computer, or through a combination of, for example, the microphone, and a remote computer. As a further alternative, programming and/or data can also be transmitted to the microprocessor through the transceiver 46.

The patient's medical history can also be stored in one of the RAMs in the form of digital data rather than in audio form. Such data can be downloaded through the above-mentioned USB port or other connection means. Alternatively, it can be transmitted by the transceiver 46.

The electronic unit 10 can be provided in a special enclosure with a clip, similar to a cell phone carrier. However, the electronic unit 10 can be small enough to be attached to a strap and hung around the neck or hung from a belt loop so that it can be immediately available as the user goes about his or her daily routine.

Finally, the shape and size of the electronic unit can be varied in accordance with design objectives, and the location of buttons, the microphone, the loudspeaker and programming interfaces can all be altered. All such variations, modifications and alternate embodiments are intended to be included within the scope of the invention as defined by the claims.

I claim:

1. An electronic assistant comprising:

a microphone;

a memory for recording voice messages spoken into said microphone;

a clock;

a loudspeaker connected to the memory for audibly reproducing said recorded messages;

a programmable control responsive to the clock, and connected to the memory, for causing recorded voice messages to be reproduced at predetermined times through the loudspeaker; and a manually operable clear switch connected to the programmable control;

wherein the programmable control causes the reproduction of each recorded message to be repeated at least a predetermined plural number of times unless said clear switch is operated;

wherein the microphone, memory, clock, loudspeaker, programmable control and clear switch are housed in a case;

wherein the programmable control comprises a switch having a mechanically movable switch-operating element settable to each of at least twelve different positions, each said position corresponding to a different time of day, said mechanically movable element being located in a recess in said case at a position such that it is inaccessible by an individual's finger, and operable only by insertion of a tool into said recess; and wherein the programmable control is operative to record, in said memory, a voice message spoken into said microphone, when the switch is in each of said positions and to associate the recorded voice message with the time of day to which the switch position corresponds when the voice message is recorded, whereby each recorded voice message is reproduced by the loudspeaker at a time of day with which it is associated.

2. An electronic assistant according to claim 1, including an alarm generator, in which the programmable control causes the reproduction of each recorded message to be repeated a predetermined plural number of times, and causes an audible alarm to be produced by the alarm generator if the clear switch is not operated within a predetermined interval beginning at the time the playing of a recorded message begins.

3. An electronic assistant according to claim 1, including an alarm generator, in which the programmable control causes the reproduction of each recorded message to be repeated a predetermined plural number of times, and causes an audible alarm to be produced by the alarm generator if the clear switch is not operated before the completion of the repetition of said recorded message.

4. An electronic assistant according to claim 1, in which said switch is a multi-position rotary switch having a screwdriver-operable switch-operating element, the switch-operating element being located in said recess in said case at a position such that it is inaccessible by an individual's finger, and operable only by insertion of a screwdriver into said recess.

5. An electronic assistant according to claim 1, in which said multi-position switch includes a position in which it allows an additional voice message to be recorded in said memory, and including a second manually operable switch connected to the microprocessor for causing the additional voice message to be reproduced whenever the second manually operable switch is operated.

6. An electronic assistant according to claim 1, including a push button connected to the clock, for setting the clock to the current hour, said push button incrementing the time by one hour for each depression of the push button, and an LED, responsive to the clock, for flashing a number of times upon each depression of the push button, said number corresponding to the hour to which the clock is set.

7. A method of assisting an individual to remember an event schedule, the method comprising the steps of:

providing a portable, handheld, electronic device containing a clock, a loudspeaker, a microprocessor, and a memory;

programming event times into said electronic device by sequentially moving a mechanically movable element of a switch having at least twelve possible positions to each of a plurality of said possible positions, each of said at least twelve positions being associated in said memory with a different event time, and said mechanically movable element being disposed in a recess at a position such that it is inaccessible by an individual's finger, and operable only by insertion of a tool into said recess;

recording an audio message into the memory when the movable element of the switch is in each of said plurality of positions, thereby associating each recorded audio message with a different event time; and retrieving audio messages from said memory that correspond to an said different event times and reproducing said messages audibly through said loudspeaker when said event times occur.

8. The method according to claim 7, further including the step of recording the individual's medical history into said memory as an audio message.

9. The method according to claim 8, further including the step of retrieving the individual's medical history by reproducing the medical history audibly through said loudspeaker.

10. The method according to claim 7, in which the reproduction of the each retrieved message is repeated and the repetition of the message is discontinued by manual operation of a clear switch on the portable, handheld, electronic device.

11. The method according to claim 10, in the microprocessor causes an alarm to be generated if said clear switch is not operated within a predetermined time following the beginning of reproduction of a retrieved message.

12. The method according to claim 11, in which the alarm is an audible alarm.

13. The method according to claim 11, in which the alarm is a radio signal.

14. The method according to claim 10, including the step of determining the location of the device by means of a global positioning system receiver in said device, and in which the alarm is a radio signal that includes information concerning the location of the device derived from the global positioning system receiver.

15. The method according to claim 7 in which said switch is a rotary switch.

16. The method according to claim 7, including the step of determining the location of the device by means of a global positioning system receiver in said device, and the step of activating an alarm by manual operation of an alert button included in said device, and thereby transmitting a radio signal that includes information concerning the location of the device derived from the global positioning system receiver.

17. The method according to claim 7, including the step of determining the location of the device by means of a global positioning system receiver in said device, and further including the step of transmitting a radio signal that includes information concerning the location of the device derived from the global positioning system receiver when the individual has not interfaced with the device for a predetermined interval of time.

* * * * *

UNITED STATES PATENT AND TRADEMARK OFFICE

CERTIFICATE OF CORRECTION

PATENT NO. : 7,428,189 B2
APPLICATION NO. : 11/901095
DATED : September 23, 2008
INVENTOR(S) : Joseph Thomas Hubicki It is certified that error appears in the above-identified patent and that said Letters Patent is hereby corrected as shown below:

In column 10, claim 7, line 13, delete “an”.

Signed and Sealed this

Twenty-fifth Day of November, 2008

JON W. DUDAS
*Director of the United States Patent and Trademark Office*